US005873167A

United States Patent [19]

Mason

[11] Patent Number: 5,873,167

[45] Date of Patent: Feb. 23, 1999

[54] CONDIMENT UTENSIL

[76] Inventor: Grady R. Mason, 801 Madison St., Gretna, La. 70053

[21] Appl. No.: 907,109

[22] Filed: Aug. 6, 1997

[51] Int. Cl.[6] ..... A47G 21/04

[52] U.S. Cl. ..... 30/125; 30/322; 30/324

[58] Field of Search ..... 30/124, 125, 141, 30/322, 324

[56] References Cited

U.S. PATENT DOCUMENTS

| | | | |
|---|---|---|---|
| 149,833 | 4/1874 | Brown et al. | 30/125 |
| 569,831 | 10/1896 | Hurlburt | 30/125 |
| 1,155,802 | 10/1915 | Dennis | 30/125 |
| 1,317,691 | 10/1919 | Fields | 30/125 |
| 1,754,973 | 4/1930 | Walch | 30/125 |
| 3,154,418 | 10/1964 | Lovell et al. | 30/141 |
| 3,208,404 | 9/1965 | Schlessel . | |
| 3,383,157 | 5/1968 | Goldhirsh . | |
| 3,565,245 | 2/1971 | Asher . | |
| 3,587,918 | 6/1971 | Cornelius . | |
| 4,099,654 | 7/1978 | Antolino . | |
| 4,231,496 | 11/1980 | Gilson . | |
| 4,471,904 | 9/1984 | Cassidy . | |
| 4,841,637 | 6/1989 | Scholzen | 30/125 |
| 4,957,226 | 9/1990 | Pacia . | |
| 5,264,267 | 11/1993 | Wang | 30/324 |
| 5,279,392 | 1/1994 | Casale et al. . | |
| 5,491,895 | 2/1996 | Lee | 30/125 |
| 5,545,450 | 8/1996 | Andersen et al. . | |

FOREIGN PATENT DOCUMENTS

| | | | |
|---|---|---|---|
| 2257020 | 1/1993 | United Kingdom | 30/324 |

*Primary Examiner*—Hwei-Siu Payer
*Attorney, Agent, or Firm*—Chase & Yakimo, L.C.

[57] ABSTRACT

A walk away packaging for condiments comprising an eating utensil and at least one storage chamber formed in the handle of the eating utensil. The chamber has an open end at the distal end of the handle and extends therefrom longitudinally through a portion of the handle. A releasable sealing member is mounted within the open end of the chamber. Preferably, two spaced apart, parallel chambers are formed in the utensil for storing different condiments.

17 Claims, 9 Drawing Sheets

CONDIMENT UTENSIL

FIELD OF THE INVENTION

This invention relates to an eating utensil, i.e., spoon, knife or fork, that also houses condiments therein for selective use. The utensil is thus especially useful with fast-food.

BACKGROUND OF THE INVENTION

The fast-food industry is booming, in part, due to the convenience and speed provided by the ability to take out food and drive through for food. Condiments are typically packaged in small paper or plastic containers for these purposes. Consumers often forget to ask for condiment packets, and typically they are not provided except upon request. Furthermore, condiment packets are not reusable and are wasteful since they must be thrown away after one use despite having some left.

SUMMARY OF THE INVENTION

Accordingly, a primary object of the subject invention is to provide a condiment packaging comprising an eating utensil having a handle portion with a chamber for storing the condiment formed within the handle portion wherein the chamber has an open end and extends longitudinally into the handle portion and terminates therein.

Another object of the subject invention is to provide a condiment packaging that is automatically provided with utensils.

A further object of the subject invention is to provide a disposable and reusable condiment packaging.

Still another object of the subject invention is to provide a condiment packaging for the fast-food restaurant business that makes available condiments that can be easily dispensed on food while eating in the car or other unlikely places.

These objects are attained by providing a condiment packaging comprising an eating utensil having a handle portion presenting a distal end relative a user and at least one chamber for storing a condiment. The chamber is formed within the handle portion and has an open end at the distal end thereof and extends longitudinally into the handle portion and terminates therein. A sealing member is mounted within each chamber's open end. Release tabs are formed integrally with the handle portion and each sealing member to releasably secure the sealing member to the handle portion.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
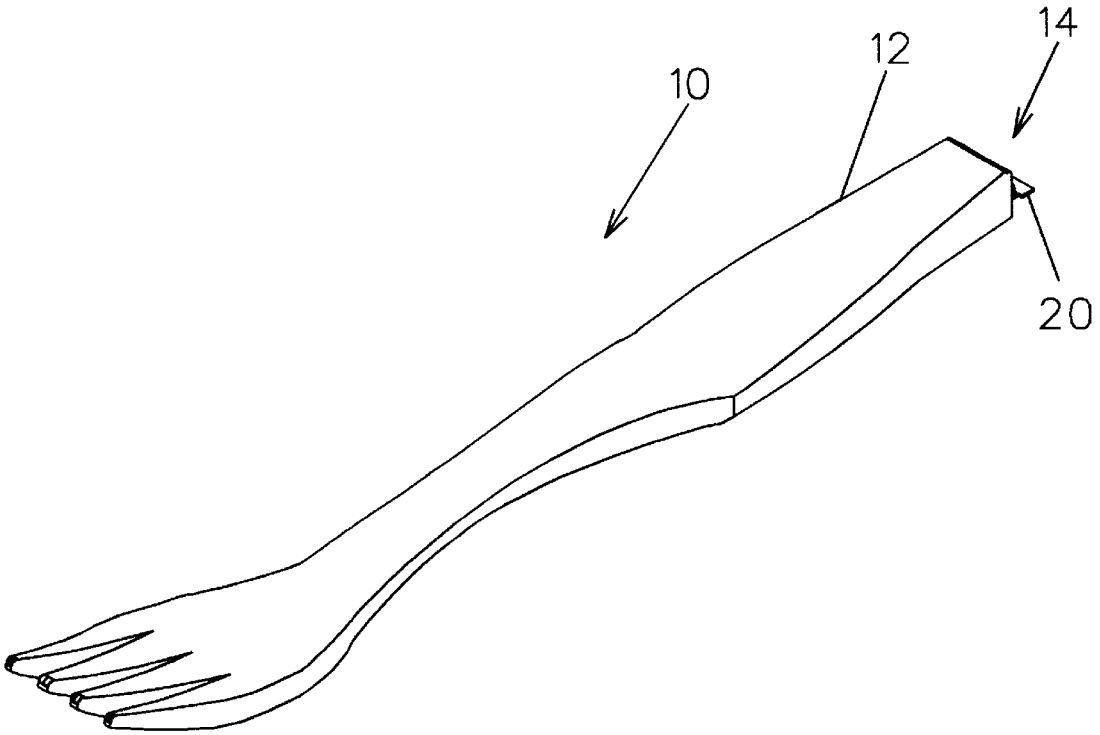
FIG. 1 is perspective view of a fork in accordance with the present invention.
Figure 2:
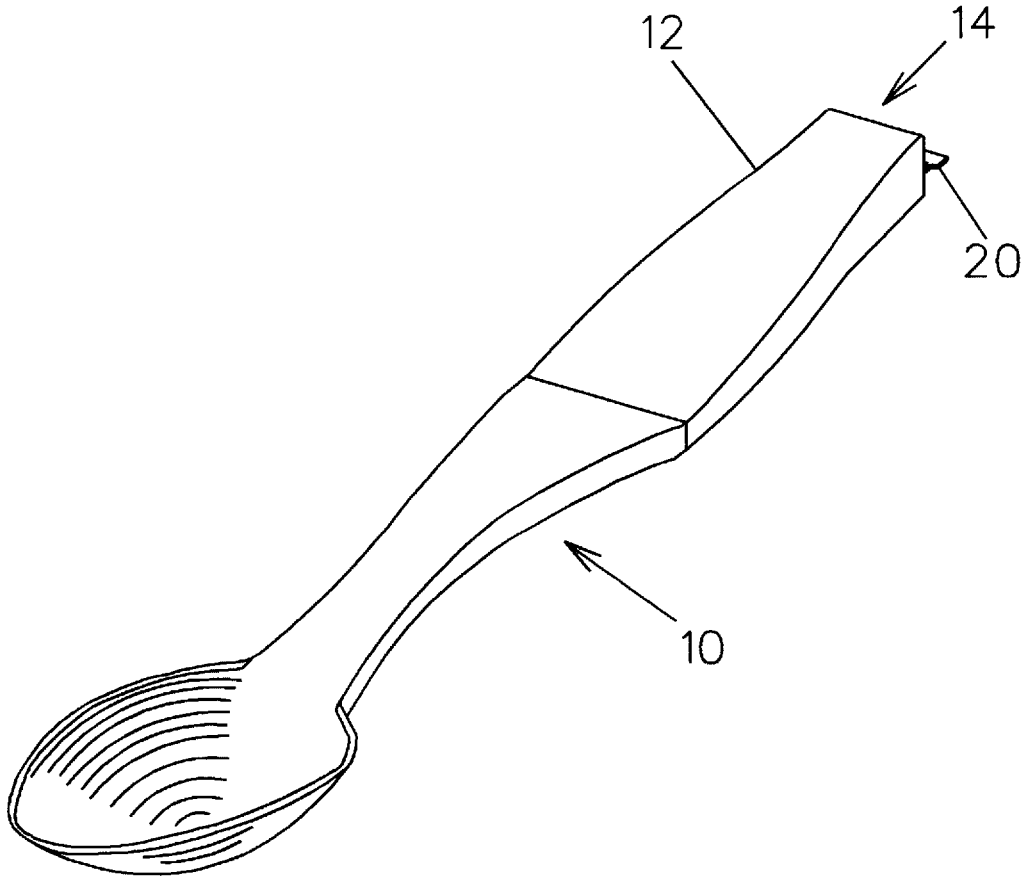
FIG. 2 is a perspective view of a spoon in accordance with the present invention.
Figure 3:
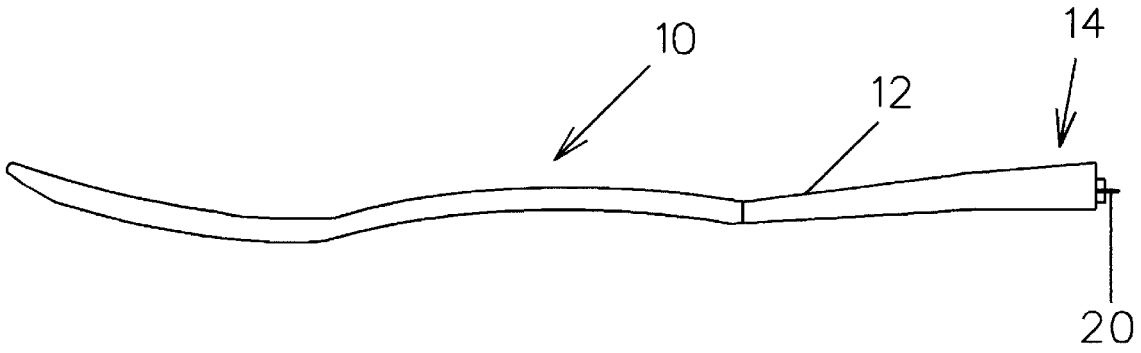
FIG. 3 is a side view of the fork of FIG. 1.
Figure 4:
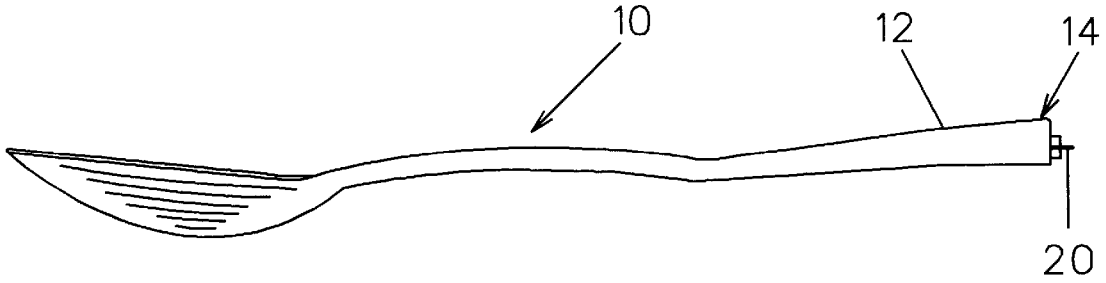
FIG. 4 is a side view of the spoon of FIG. 2.
Figure 5:
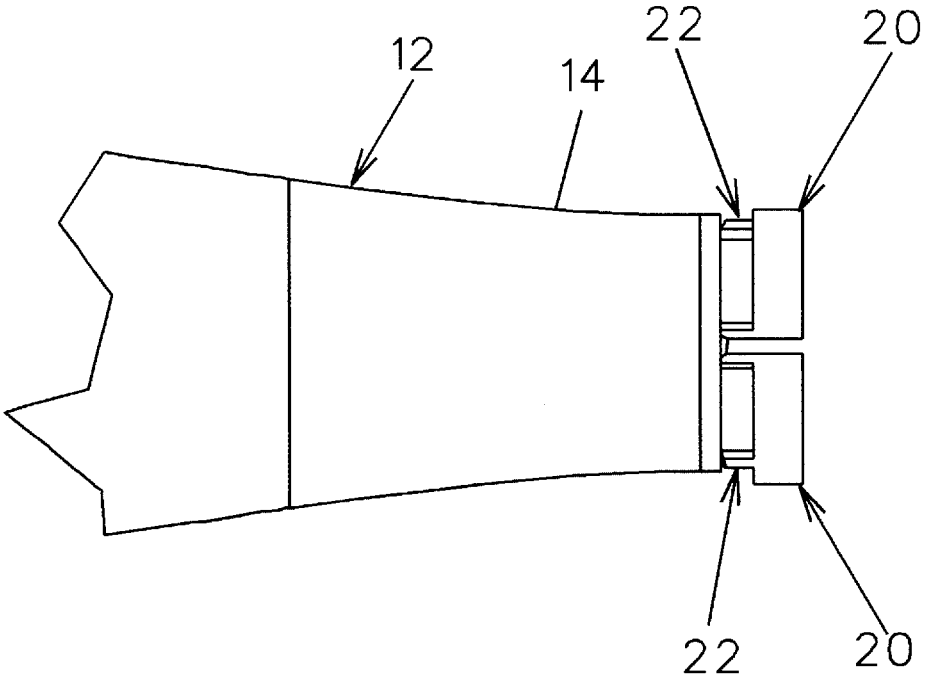
FIG. 5 is a top plan view of the distal end of the handle portion of the fork or spoon of FIGS. 1 and 2.
Figure 6:
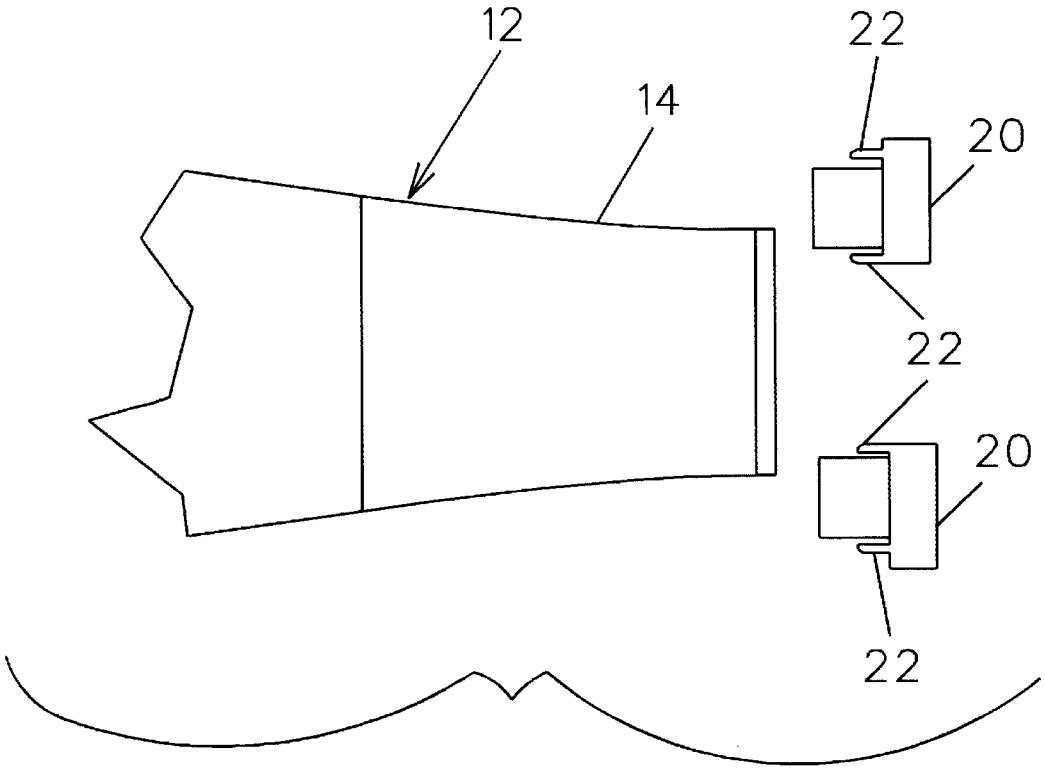
FIG. 6 is a top plan view of the distal end of the handle portion as in FIG. 5 with the sealing members released from within the storing chambers.
Figure 7:
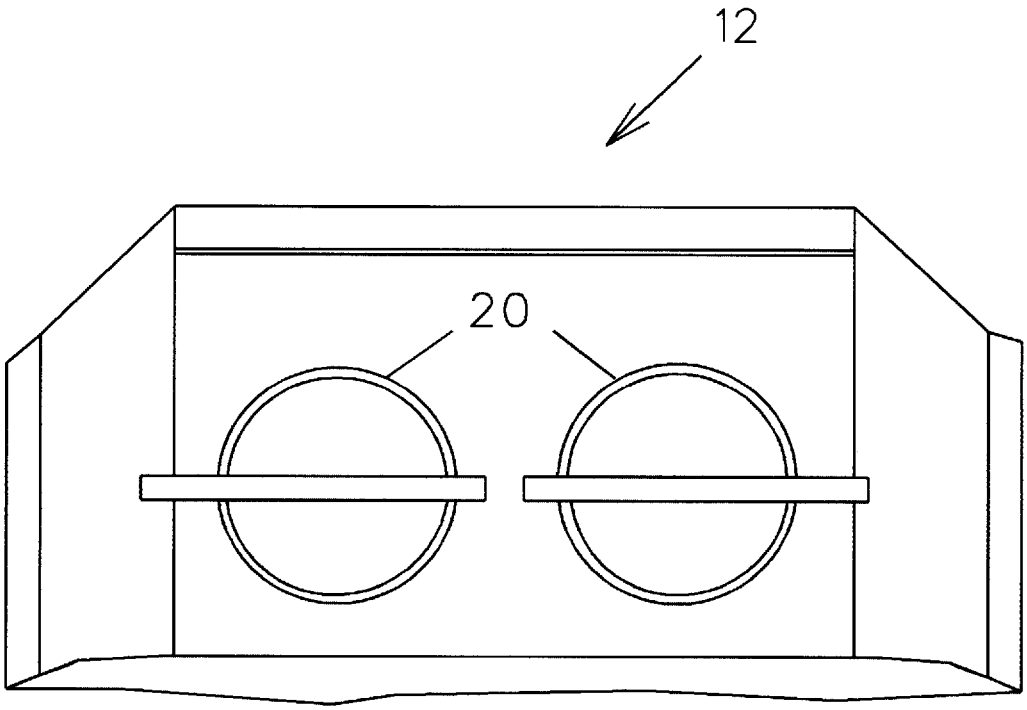
FIG. 7 is an end view of the distal end of the handle of FIGS. 1 and 2.
Figure 8:
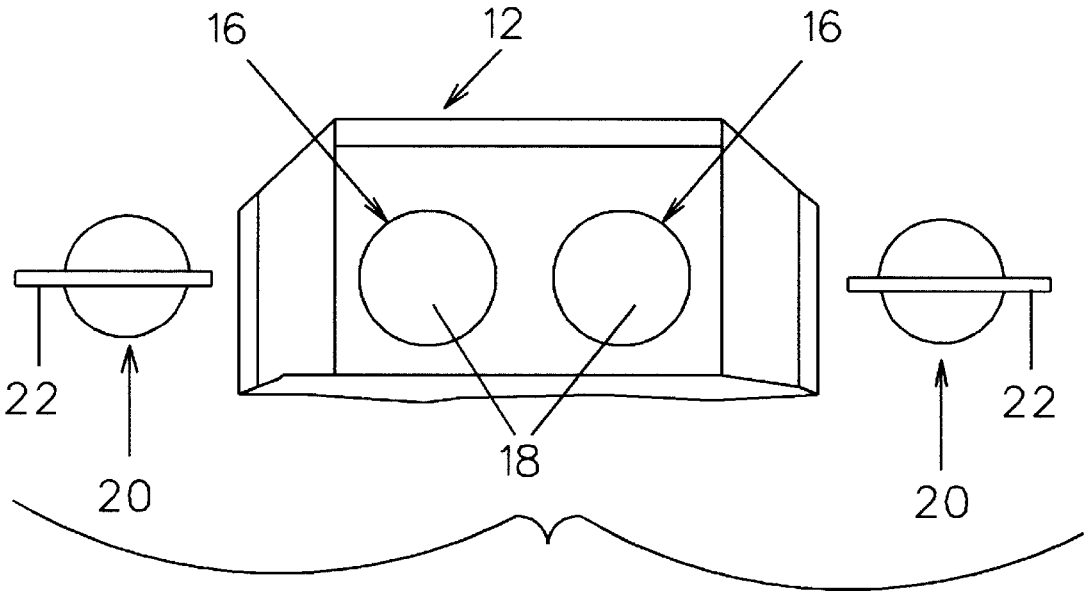
FIG. 8 is an end view of the distal end with the sealing members removed therefrom.

A utensil 10, such as a fork as in FIGS. 1 and 3, spoon, as in FIGS. 2 and 4, or a knife (not shown), in accordance with the present invention, stores dry condiments, i.e., powder or granular condiments such as salt, pepper or sugar, within the handle 12. The condiments are easily selectively released from within handle 12 for applying to the user's food as desired.

Utensil 10 is preferably molded from plastic and is similar to conventional plastic utensils except its handle 12 may be slightly enlarged to store a sufficient amount of the condiments therein. Otherwise, handle 12 is elongated similar to any fork, spoon or knife. Handle 12 presents the distal end 14 of the utensil 10 relative to the user's mouth while eating.

Figure 9:
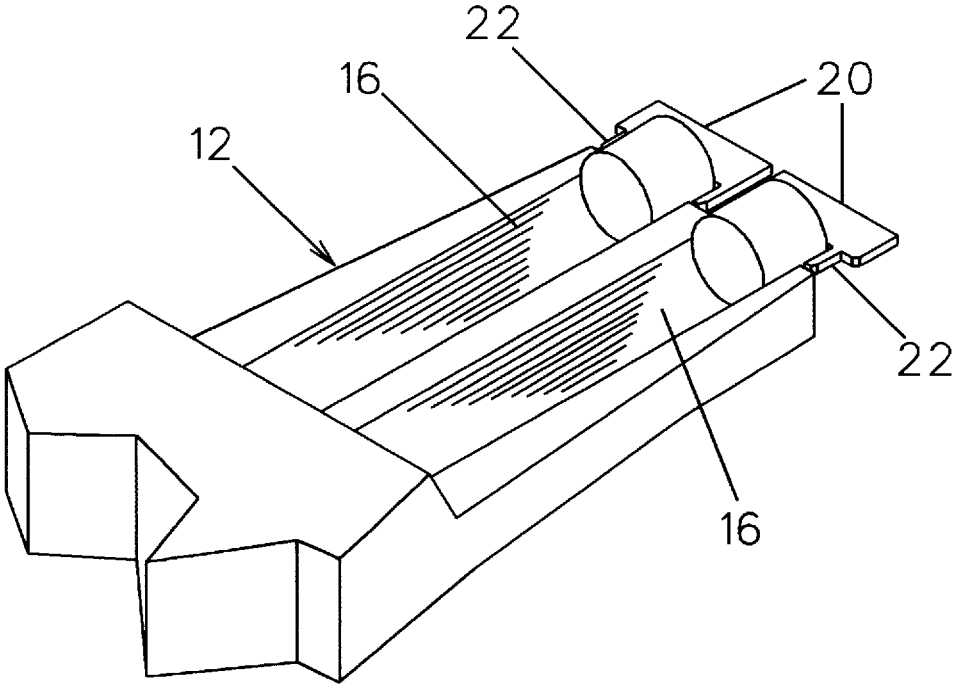
FIG. 9 is a perspective view of the distal end of FIGS. 1 and 2 broken away to show the condiment storing chambers formed therein.

Preferably, two chambers 16 for storing a condiment are formed within handle 12. Because chambers 16 are identical they will be referred to as the same reference numeral 16. Chambers are formed side by side and are spaced apart within handle 12. They extend from an open end 18 formed at distal end 14 into handle 12, where they terminate therein. Of course, utensil 10 may include only one or any number of chambers. Preferably, chambers 16 have sufficient volume to hold an amount of one type of condiment for the consumption of at least one meal. As shown in FIG. 9, chambers 16 are rectangular, spaced apart and extend in parallel relation within handle 12. However, chambers 16 can be any size or shape.

Sealing members 20 preferably take the form of caps or plugs as seen in FIGS. 5–8 which fit snugly within the open end 18 of each chamber 16 and a portion of each plug 20 extends outwardly from within chamber 16. Plugs 20 are secured to the distal end 14 of handle 12 by release tabs 22, which are integrally formed with handle 12 and plug 20. Plugs 20 are withdrawn from open end 18 of each chamber 16 through a twist action that breaks release tabs 22 and a pulling action that removes each plug 20 from within each open end 18. Preferably, each plug 20 has two opposed release tabs 22 securing it to the handle 12. Plugs 20 can be reinserted within each open end 18 to re-plug or re-seal each chamber 16 if the full amount of each condiment is not used.

Alternatively, instead of plugs, sealing member 20 can take the form of peel-off tabs. Such tabs, however, do not allow for reuse of the condiment if tabs do not reseal chamber 16. Such tabs are discarded after opening each chamber 16.

As an example, a spoon 10 may store an amount of sugar in one chamber 16 and creamer in the other chamber 16 for use when coffee is ordered. Each condiment is easily selectively poured into the coffee by withdrawing plugs 20 from within chambers 16 and pouring the sugar and creamer into the coffee. The spoon is then used to stir the coffee and can be discarded. Of course, if any of the condiment is not used, the spoon 10 can be stored for subsequent use.

Thus, the fast-food restaurant business is provided with another convenient method of allowing the general public to eat out and still have readily available favorite condiments that can be easily dispensed on food.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. An eating utensil with condiments stored therein, comprising:

a handle presenting a distal end;

a plurality of spaced apart chambers in said handle, each said chamber storing a condiment therein and having an open end at said distal end of said handle and extending longitudinally therefrom through a portion of said handle;

means for sealing each said chamber mounted within each said open end; and means formed integrally with said handle and with each said means for sealing for releasably securing said means for sealing to said handle.

2. An eating utensil as claimed in claim 1 wherein said utensil is a fork.

3. An eating utensil as claimed in claim 1 wherein said utensil is a spoon.

4. An eating utensil as claimed in claim 1 wherein said means for sealing is a removable cap at each said open end.

5. An eating utensil as claimed in claim 1 wherein said means for releasably securing is a tab at each said open end.

6. An eating utensil as claimed in claim 1 wherein said means for releasably securing includes release tabs integrally formed with said handle and with said means for sealing.

7. An eating utensil as claimed in claim 1 wherein said means for releasably securing includes two opposed release tabs which secure each said means for sealing to said handle.

8. An eating utensil with a condiment stored therein, comprising:

a handle portion presenting a distal end;

a chamber adapted for storing a condiment, said chamber formed within said handle portion and having an open end at said distal end thereof and extending longitudinally from said open end and terminating within said handle portion;

means for sealing said chamber mounted within said open end;

means formed integrally with said handle portion and with said means for sealing for releasably securing said means for sealing to said handle portion.

9. An eating utensil as claimed in claim 8 wherein said handle portion has a plurality of said chambers formed therein with said means for sealing mounted within each open end of each said chamber.

10. An eating utensil as claimed in claim 8 wherein said utensil is a fork.

11. An eating utensil as claimed in claim 8 wherein said utensil is a spoon.

12. An eating utensil as claimed in claim 8 wherein said means for sealing is a removable cap.

13. An eating utensil as claimed in claim 8 wherein said means for releasably securing is a tab.

14. An eating utensil as claimed in claim 8 wherein said means for releasably securing includes release tabs integrally formed with said handle portion and with said means for sealing.

15. An eating utensil as claimed in claim 8 wherein said means for releasably securing includes two opposed release tabs which secure said means for sealing to said handle portion.

16. An eating utensil with a condiment stored therein, comprising:

a handle presenting a distal end;

a chamber adapted for storing a condiment, said chamber formed within said handle and having an open end at said distal end thereof and extending longitudinally from said open end and terminating within said handle;

a removable sealing plug mounted within said open end;

opposed release tabs integrally formed with said handle and with said sealing plug to removably secure said sealing plug to said handle.

17. An eating utensil as claimed in claim 16 wherein:

at least two of said chambers are formed within said handle, said chambers being spaced apart in parallel relationship.

* * * * *